US007910817B1

(12) United States Patent
Huang

(10) Patent No.: US 7,910,817 B1
(45) Date of Patent: Mar. 22, 2011

(54) DRUM

(76) Inventor: Ming-Fang Huang, Taichung County (TW)

( * ) Notice: Subject to any disclaimer, the term of this patent is extended or adjusted under 35 U.S.C. 154(b) by 21 days.

(21) Appl. No.: 12/564,835

(22) Filed: Sep. 22, 2009

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | |
|---|---|---|---|---|
| 3,674,911 | A * | 7/1972 | Phillips et al. | 84/411 R |
| 4,605,254 | A * | 8/1986 | Carmien | 294/57 |
| 4,714,002 | A * | 12/1987 | Cleland | 84/413 |
| 4,928,565 | A * | 5/1990 | Hsieh | 84/411 R |
| 5,293,000 | A * | 3/1994 | Adinolfi | 84/730 |
| 5,542,230 | A * | 8/1996 | Schutze | 52/848 |
| 5,632,837 | A * | 5/1997 | Carmien | 156/172 |
| 6,354,334 | B1 * | 3/2002 | Ellyin et al. | 138/143 |
| 6,889,716 | B2 * | 5/2005 | Lundberg et al. | 138/130 |
| 7,009,099 | B1 * | 3/2006 | Belli | 84/411 R |
| 7,456,350 | B2 * | 11/2008 | Neumayer et al. | 84/411 R |
| 7,462,770 | B2 * | 12/2008 | Dunnett | 84/411 R |
| 7,495,160 | B2 * | 2/2009 | Hoshino et al. | 84/411 R |
| 7,786,363 | B1 * | 8/2010 | Wei | 84/411 R |
| 7,807,013 | B2 * | 10/2010 | Wideman et al. | 156/325 |
| 2002/0117228 | A1 * | 8/2002 | Nakajima et al. | 138/153 |
| 2007/0251373 | A1 * | 11/2007 | Fadda | 84/411 R |
| 2008/0173158 | A1 * | 7/2008 | Lee | 84/421 |
| 2009/0038464 | A1 * | 2/2009 | Chen | 84/411 R |
| 2010/0119862 | A1 * | 5/2010 | Wilson | 428/586 |

* cited by examiner

*Primary Examiner* — Elvin G Enad
*Assistant Examiner* — Robert W Horn

(57) ABSTRACT

A drum comprises a drum body made of at least one fiber layer. The drum body is provided with a drumhead at each of two opposite ends thereof. The drumheads are positioned on two reinforced frames disposed at both ends of the drum body by two drum hoops, so that the contact area between the drumheads and the drum body can be reduced through the reinforced frames. In addition, the reinforced frames reinforce the structure and maintain the shape of the drum body. Plural positioning screws are inserted through the periphery of the respective drum hoops, and the drum body is provided with plural fixing members to be screwed with the positioning screws. By such arrangements, the drum not only has the advantages of reinforced structure, light weight and easy production but exert a better resonance effect, making the sound produced by the drum more robust and powerful.

7 Claims, 4 Drawing Sheets

DRUM

BACKGROUND OF THE INVENTION

1. Field of the Invention

The present invention relates to a drum; and more particularly to a drum which is made of fiber to reinforce its structure, reduce its weight and improve its resonance effect.

2. Description of the Prior Art

A conventional drum comprises a drum body made of either wood or metal. Although both the wood-made drum and the metal-made drum can produce a sound when being beaten, based on a further analysis, the conventional drum suffers from the following defects.

The wood-made drum body has low structure strength due to the characteristic of the wood. In addition, the making of a wood-made drum body includes the steps of machining plural wood pieces one by one and then assembling them together, so it takes lots of time and labor and is not economic. Further, the clearances formed between the connected wood pieces adversely affect the resonance effect of the drum.

As for the metal-made drum body, although it has a high strength structure, its weight is greatly increased, making it inconvenient to carry. In addition, the oxidation characteristic of the metal further adversely affects the tone of the drum.

Referring to FIG. 1, a conventional drum 90 comprises a drum body 91 made of wood or metal. Both ends of the drum body 91 have an un-processed rough edge A which is prone to scratching the drumheads 92, and therefore, the drumheads 92 must be replaced frequently, inevitably increasing the maintenance cost of the drum 90.

The present invention has arisen to mitigate and/or obviate the afore-described disadvantages.

SUMMARY OF THE INVENTION

The primary objective of the present invention is to provide a fiber-made drum.

In order to achieve the above objective, a drum in accordance with the present invention comprises a drum body in the form of a hollow cylinder, two reinforced frames, plural cylinder-shaped fixing members, two drumheads, two drum hoops and plural positioning screws. The drum body is made of at least one fiber layer. The two reinforced frames are disposed at both ends of the drum body. The respective fixing members are clad with a fiber layer and have a lateral side fixed to the outer peripheral surface of the drum body. The two drumheads each utilize a periphery thereof to cover the respective drumheads. The two drum hoops each are clad with a fiber layer and disposed on the respective drumheads. The respective positioning screws are inserted through the periphery of the respective drum hoops and screwed into the respective fixing members.

Based on a further analysis, the present invention has the following advantages: the drum body of the drum of the present invention is made of fiber layers, and each of the fixing members and the drum hoops are clad with a fiber layer, so the drum of the present invention not only has the advantages of reinforced structure, light weight and easy production but exert a better resonance effect, making the sound produced by the drum more robust and powerful.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
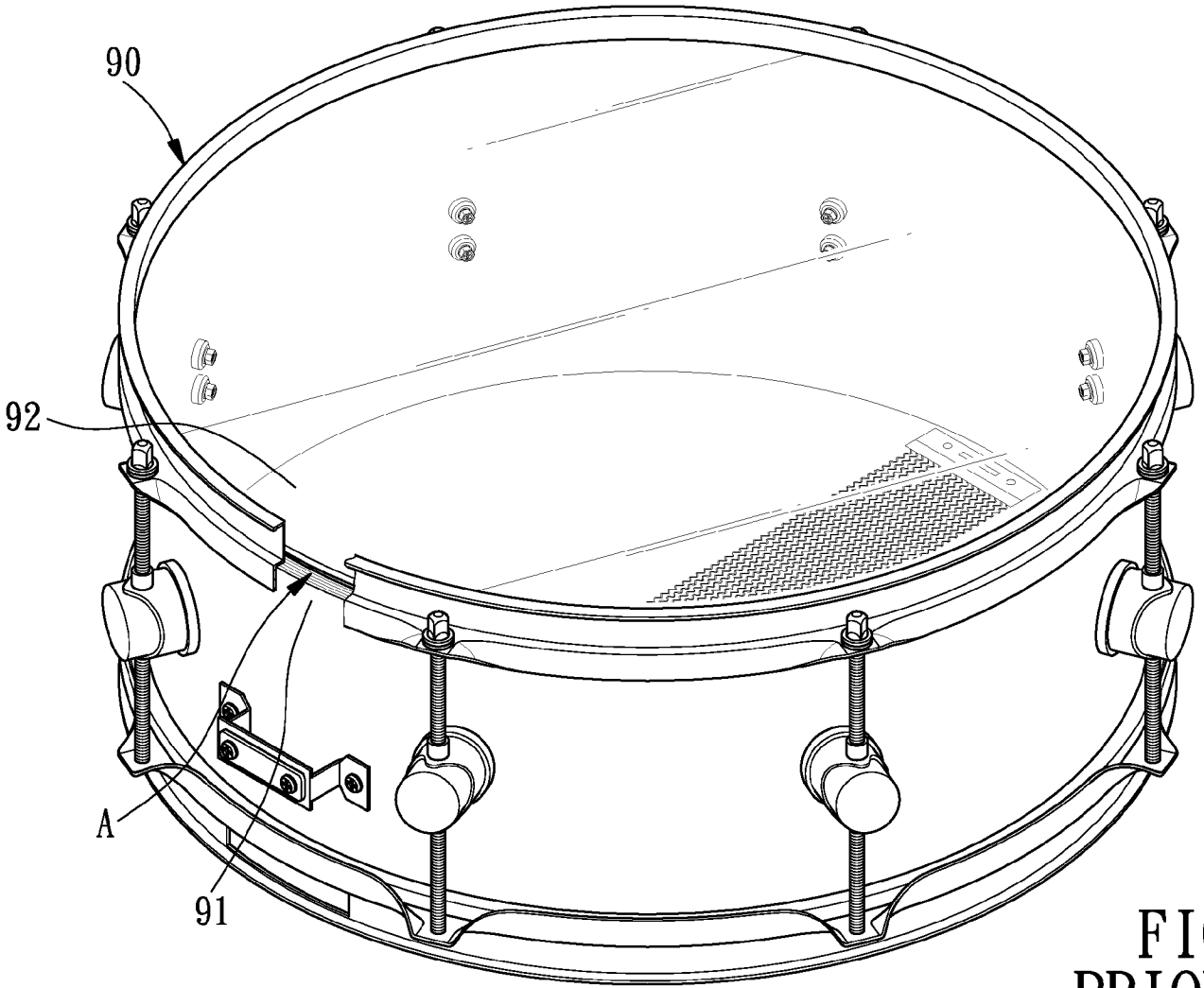
FIG. 1 PRIOR ART
FIG. 1 is a perspective view of a conventional drum.
Figure 2:
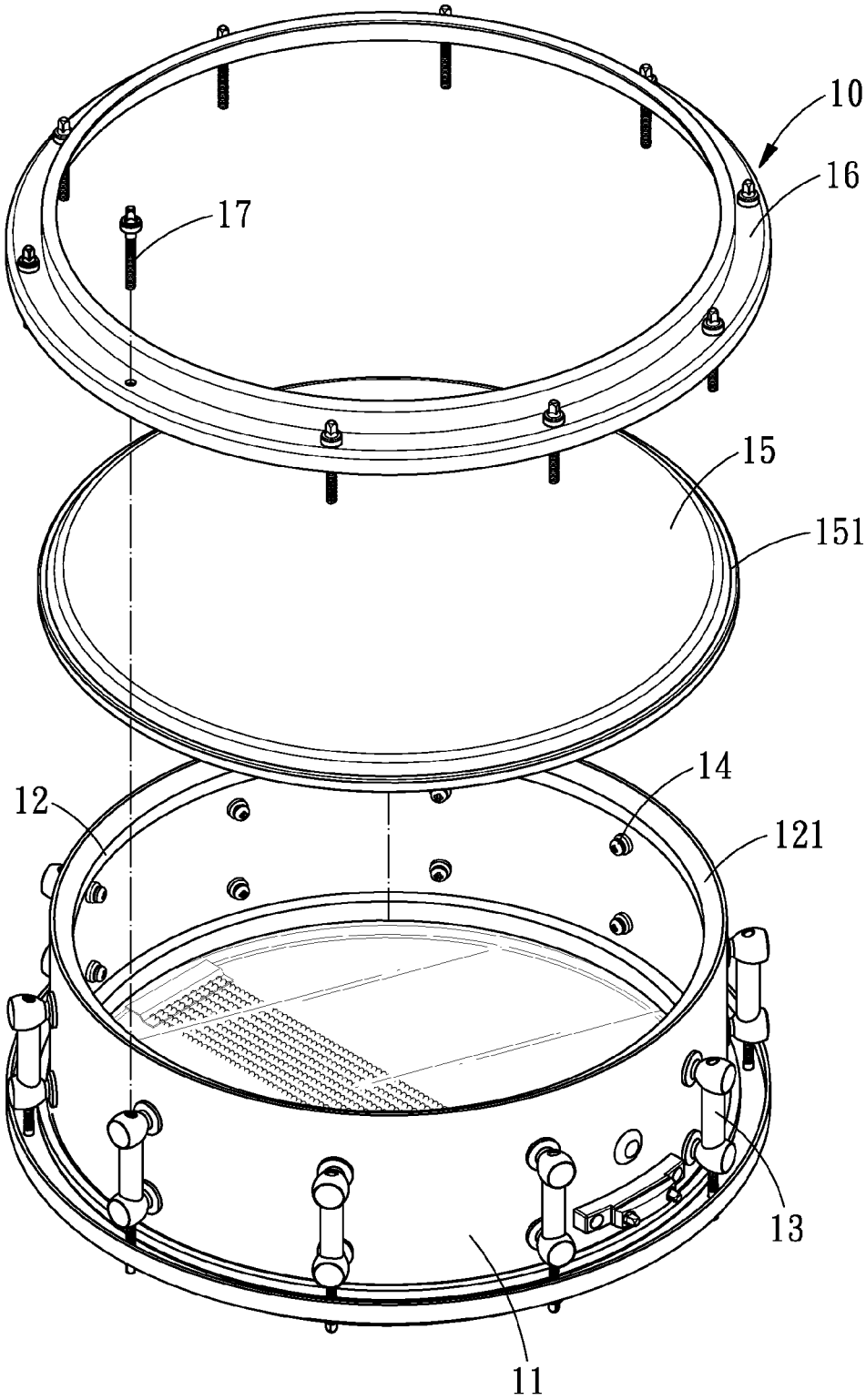
FIG. 2 is an exploded view of a drum in accordance with the present invention.
Figure 3:
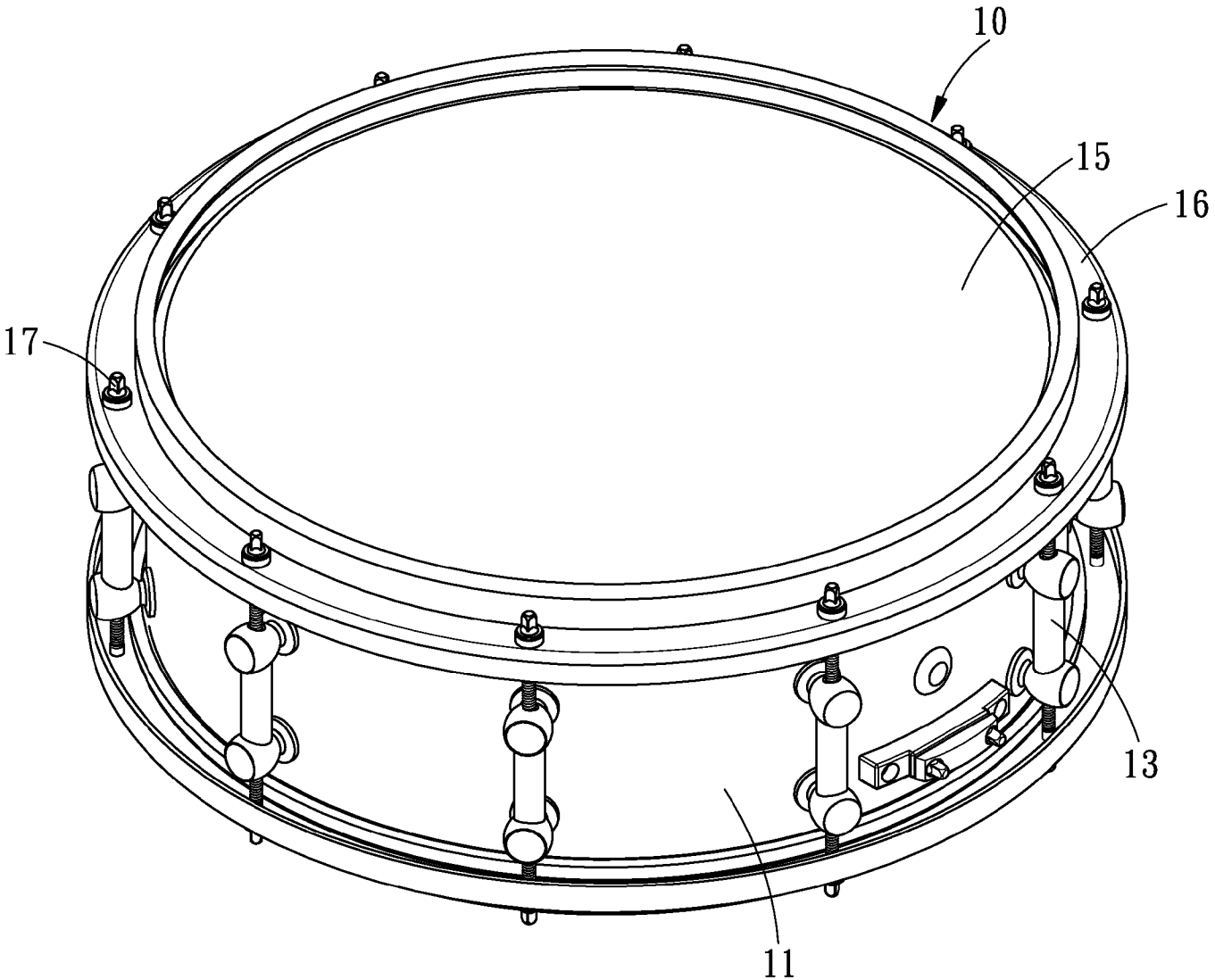
FIG. 3 is a perspective view of the drum in accordance with the present invention.
Figure 4:
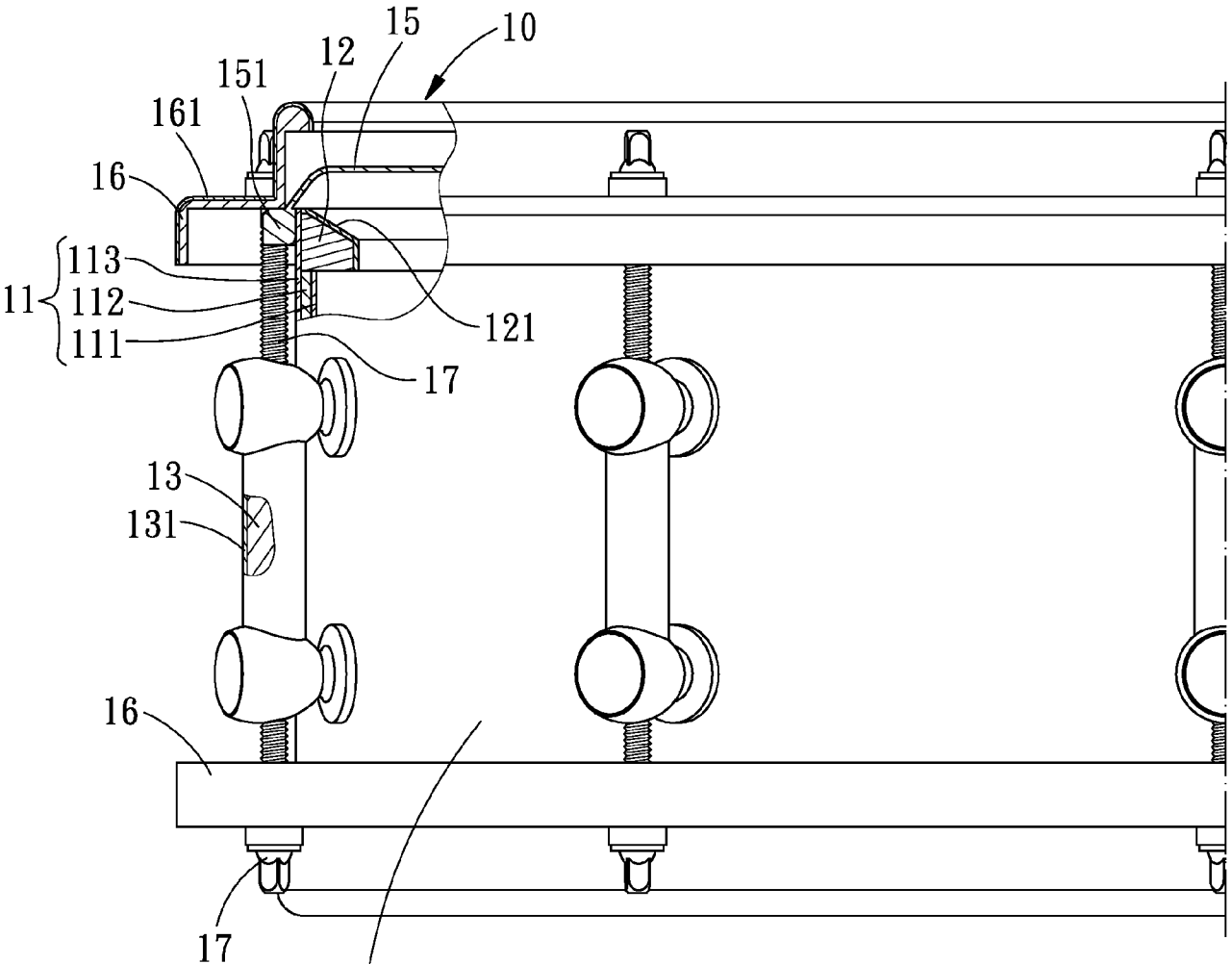
FIG. 4 is a partial cross-sectional of the drum in accordance with the present invention.

Referring to FIGS. 2-4, a drum 10 in accordance with the present invention comprises a drum body 11, two reinforced frames 12, plural fixing members 13, plural fixing screws 14, two drumheads 15, two drum hoops 16 and plural positioning screws 17.

The drum body 11 is in the form of a hollow cylinder and made of three fiber layers that are a first fiber layer 111, a second fiber layer 112 and a third fiber layer 113. The process for forming the drum body 11 includes the steps of attaching the first fiber layer 111 which is made by interlacing first and second carbon fibers or glass fibers to an outer peripheral surface of a cylinder, and then disposing the second fiber layer 112 which is made by winding carbon fiber or glass fiber around an outer peripheral surface of the first fiber layer 111, subsequently, attaching the third fiber layer 13 which is made by interlacing first and second carbon fibers or glass fibers to the outer peripheral surface of the second fiber layer 112, and finally pulling out the cylinder to finish the formation of the drum body 11.

When the drum body 11 is made of one fiber layer, the drum body 11 is made of the second fiber layer 112. The process for forming the drum body 11 includes the steps of disposing the second fiber layer 112 which is made by winding carbon fiber or glass fiber around the outer peripheral surface of a cylinder, and finally pulling out the cylinder to finish the formation of the drum body 11.

The two reinforced frames 12 are disposed at both ends of the drum body 11 to maintain the shape of the drum body 11. The respective reinforced frames 12 are formed with an inclined surface 121 at a top side thereof.

The respective fixing members 13 are cylinder-shaped and fixed to the outer peripheral surface of the drum body 11 at regular intervals by the fixing screws 14 which are inserted through the outer peripheral surface of the drum body 11 and screwed into the lateral side of the respective fixing members 13. The respective fixing members 13 are clad with a fiber layer 131 made by interlacing first and second carbon fibers or glass fibers.

Each of the two drumheads 15 is provided with a limiting frame 151 around an outer periphery thereof. The respective drumheads 15 have an inner periphery covered on the respective inclined surfaces 121 of the reinforced frames 12 in such a manner that the respective drumheads 15 abut against a higher portion of the respective inclined surfaces 121 but not the whole inclined surfaces 121. The inclined surface 121 of the respective reinforced frames 12 is processed to reduce its surface roughness, so that the friction between the inclined surface 121 of the reinforced frame 12 and the drumhead 15 can be reduced. The respective drumheads 15 are disposed around the periphery of the drum body 11 by the limiting frames 151, by such arrangements, the respective limiting frames 151 serve as a medium to reduce the abrasion between the drumheads 15 and the drum body 11.

On an outer surface of the respective drum hoops 16 is clad a fiber layer 161 which is made by interlacing first and second carbon fibers or glass fibers. The drum hoops 16 are disposed on the respective drumheads 15 and abutted against the respective limiting frames 151. The respective positioning screws 17 have one end inserted through the periphery of the respective drum hoops 16 and screwed into one end of the respective fixing members 15 in such a manner that the periphery of the respective drum hoops 16 is pressed against by the positioning screws 17 to make the respective drum hoops 16 press the limiting frames 151 downwards to force the drumheads 15 to tightly abut against the respective reinforced frames 12.

The drum body 11 of the present invention is made of fiber, and each of the fixing members 13 and the drum hoops 16 is clad with fiber, so the structure strength of the drum 10 of the present invention is enhanced, and since the carbon fiber has the advantage of light weight, the weight of the drum 10 of the present invention is greatly reduced. In addition, the ductility of the carbon fiber can further improve the resonance effect to make the sound of the drum more robust and powerful, and further the drum body 11 can absorb the shake caused by impact.

Since the carbon fiber is easy to produce, the drum body 11 of the present invention can be produced by one step, namely, without the steps of assembling or welding. Therefore, the production of the drum body 11 is relatively simple, quick and economic.

The fiber-made drum body 11 doesn't have any clearance, so the whole structure of the drum 10 is more durable and exerts the better resonance effect, making the sound produced by the drum of the present invention more robust and powerful.

While we have shown and described various embodiments in accordance with the present invention, it is clear to those skilled in the art that further embodiments may be made without departing from the scope of the present invention.

What is claimed is:

1. A drum comprising:

a drum body being in the form of a hollow cylinder and made of at least one fiber layer;

two reinforced frames being disposed at both ends of the drum body;

plural cylinder-shaped fixing members each having a lateral side screwed to an outer peripheral surface of the drum body, and on the respective fixing members being clad a fiber layer;

two drumheads being covered on the respective reinforced frames;

two drum hoops each being clad with a fiber layer and disposed on the respective drumheads; and plural positioning screws being inserted through a periphery of the respective drum hoops and screwed into one end of the respective fixing members.

2. The drum as claimed in claim 1, wherein the drum body is made of one fiber layer made by winding carbon fiber or glass fiber.

3. The drum as claimed in claim 1, wherein the drum body is made of three fiber layers that are a first fiber layer, a second fiber layer and a third fiber layer, the first fiber layer is made by interlacing first and second carbon fibers or glass fibers, the second fiber layer is made by winding carbon fiber or glass fiber around an outer peripheral surface of the first fiber layer, the third fiber layer is made by interlacing first and second carbon fibers or glass fibers and attached to an outer peripheral surface of the second fiber layer.

4. The drum as claimed in claim 1, wherein the respective reinforced frames are formed with an inclined surface at a top side thereof.

5. The drum as claimed in claim 1, wherein the fixing members are fixed to the outer peripheral surface of the drum body at regular intervals by plural fixing screws which are inserted through the outer peripheral surface of the drum body and screwed into the lateral side of the respective fixing members, the fiber layer of the respective fixing members is made of carbon fiber or glass fiber.

6. The drum as claimed in claim 1, wherein the respective drumheads are provided with a limiting frame around an outer periphery thereof cooperating with the respective drum hoops, an inner periphery of the respective drumheads covers the inclined surface of the respective reinforced frames in such a manner that the respective drumheads abut against a higher portion of the respective inclined surfaces of the reinforced frames.

7. The drum as claimed in claim 1, wherein the fiber layer of the respective drum hoops is made of carbon fiber or glass fiber, a periphery of the respective drum hoops is pressed against by the positioning screws to make the respective drum hoops press the limiting frames downwards to force the drumheads abut against the respective reinforced frames.

* * * * *